US007527215B1

(12) United States Patent
Siddiqui

(10) Patent No.: US 7,527,215 B1
(45) Date of Patent: May 5, 2009

(54) AUTOMATIC TISSUE DISPENSER APPARATUS

(76) Inventor: Zafar A. Siddiqui, 17577 Kings Hwy., Montross, VA (US) 22520

( * ) Notice: Subject to any disclaimer, the term of this patent is extended or adjusted under 35 U.S.C. 154(b) by 84 days.

(21) Appl. No.: 11/674,267

(22) Filed: Feb. 13, 2007

(51) Int. Cl.
*B65H 26/00* (2006.01)
*B65H 75/18* (2006.01)

(52) U.S. Cl. ..... 242/563; 242/598.5; 242/564.2; 225/10

(58) Field of Classification Search ..... 242/563, 242/563.2, 564, 564.1, 564.2, 565, 598.5, 242/596.8, 599.3, 599.4; 312/34.1, 34.22, 312/34.8; 225/10, 47; 226/121, 127, 128, 226/129; D6/518, 519, 522, 523
See application file for complete search history.

(56) References Cited

U.S. PATENT DOCUMENTS 1,928,106 A * 9/1933 Koch et al. ..... 242/596.8
3,730,409 A 5/1973 Ratti
4,119,255 A 10/1978 D'Angelo
5,772,291 A 6/1998 Byrd et al.
5,868,335 A * 2/1999 Lebrun ..... 242/596.8
6,056,233 A * 5/2000 Von Schenk ..... 242/598.5
7,354,015 B2 * 4/2008 Byrd et al. ..... 242/563
D572,058 S * 7/2008 Cittadino et al. ..... D6/518
7,398,944 B2 * 7/2008 Lewis et al. ..... 242/563
2006/0169827 A1 * 8/2006 Lewis et al. ..... 242/563

* cited by examiner

*Primary Examiner*—William A Rivera
(74) *Attorney, Agent, or Firm*—Crossley Patent Law; Mark Ashley Crossley

(57) ABSTRACT

The automatic tissue dispenser apparatus provides for user-determined tissue length dispensed. The motion sensor activates and deactivates dispensing to provide user control. A cutting edge is provided for tearing tissue as chosen. A hand crank is optionally provided to negate dysfunction in the event of power or component failure. A stanchion with base is optionally provided for a free-standing dispenser.

8 Claims, 6 Drawing Sheets

AUTOMATIC TISSUE DISPENSER APPARATUS

BACKGROUND OF THE INVENTION

The desirability of automatic dispensing of paper towels is established. Various types of dispensers have been developed. Dispensers which require constant hand or finger pressure are not desirable to any individual who either cannot supply such pressure or does not wish to touch the dispenser. Dispensers which dispense only a pre-determined amount of towel are undesirable, as the use of such dispensers typically lends itself to only one use, such as dispensing paper towels. Even then, such dispensers often lead to waste, as users typically keep triggering the dispensers out of frustration at being monitored and metered by a machine, rather than personal wishes. Further, automatic dispensers do not work in the even of electrical power failure or dispenser component failure, with such failures being commonly understood by any frequent user.

What is needed is a basic, inexpensively produced apparatus which provides for use with paper towels or toilet tissue or the like, and which provides user controlled delivery, while also providing hand crank backup dispensing in case of power or electrical component failure.

FIELD OF THE INVENTION

The automatic tissue dispenser apparatus relates to paper towel and toilet tissue dispensing and more particularly to an automatic tissue dispenser apparatus which dispenses a user-determined amount, and which has a hand crank backup.

DESCRIPTION OF THE PRIOR ART

Prior related art U.S. Pat. No. 5,772,291 issued to Byrd et al. on 1998 Jun. 30 teaches a hands-free paper towel dispenser. The dispenser employs a different gear drive, roller assembly, and feed compared to the present apparatus. The dispenser dispenses only a predetermined towel length, and does not include a hand crank backup. U.S. Pat. No. 4,119,255 issued to D'Angelo on 1978 Oct. 10 teaches an apparatus for automatically dispensing material from a roll. The roller and dispensing mechanism differ from the present apparatus. Additionally, the apparatus is designed to dispense only in lengths determined by pre-selected time intervals. The apparatus does not have a crank backup.

U.S. Pat. No. 3,730,409 issued to Ratti on 1973 May 1 teaches a dispensing apparatus which dispensing only a predetermined length of paper towel. The apparatus does not include a hand crank backup, nor does the apparatus employ the same gear drive and roller mechanisms of the present apparatus.

While the above-described devices fulfill their respective and particular objects and requirements, they do not describe a automatic tissue dispenser apparatus that provides for the advantages of the automatic tissue dispenser apparatus. In this respect, the automatic tissue dispenser apparatus substantially departs from the conventional concepts and designs of the prior art. Therefore, a need exists for an improved automatic tissue dispenser apparatus.

SUMMARY OF THE INVENTION

The general purpose of the automatic tissue dispenser apparatus, described subsequently in greater detail, is to provide a automatic tissue dispenser apparatus which has many novel features that result in an improved automatic tissue dispenser apparatus which is not anticipated, rendered obvious, suggested, or even implied by prior art, either alone or in combination thereof.

To attain this, the automatic tissue dispenser apparatus provides for user-determined tissue dispensing. The motion sensor alternately activates and deactivates the motor driven gears of the apparatus to dispense tissue. A user is thereby not limited to a given dispensed amount. By allowing a user to select the amount of tissue desired, user waste is actually diminished.

With pre-selected amounts dispensed, in other devices within the art, users typically activate mechanisms repeatedly in frustration, in order to obtain the desired amount of tissue. Waste is often the result.

The apparatus is provided in various embodiments whereby tissue or paper towels or the like can be dispensed. The apparatus is basic in design, with direct gear interactions in avoidance of complexity or failures that may be associated with more complex devices.

The apparatus further provides a hand crank in case of any failure of power supply, gears, sensor, or motor. Typically, devices which are powered and experience failure, will not dispense tissue to a user. The current apparatus overcomes this shortcoming.

Thus has been broadly outlined the more important features of the improved automatic tissue dispenser apparatus so that the detailed description thereof that follow may be better understood and in order that the present contribution to the art may be better appreciated.

An object of the automatic tissue dispenser apparatus is to be inexpensive.

Another object of the automatic tissue dispenser apparatus is to offer a towel or a tissue dispenser.

A further object of the automatic tissue dispenser apparatus is to provide for user-chosen dispensed lengths of towels and tissues.

An added object of the automatic tissue dispenser apparatus is to provide a hand crank backup.

And, an object of the automatic tissue dispenser apparatus is to easy fill and internal access.

Further, an object is to conserve tissue by allowing a user to dispense exactly the amount needed.

These together with additional objects, features and advantages of the improved automatic tissue dispenser apparatus will be readily apparent to those of ordinary skill in the art upon reading the following detailed description of presently preferred, but nonetheless illustrative, embodiments of the improved automatic tissue dispenser apparatus when taken in conjunction with the accompanying drawings.

In this respect, before explaining the current embodiments of the improved automatic tissue dispenser apparatus in detail, it is to be understood that the automatic tissue dispenser apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved automatic tissue dispenser apparatus. It is therefore important that the claims be regarded as including such equivalent constructions insofar as they do not depart from the spirit and scope of the automatic tissue dispenser apparatus. It is also to be understood that the phraseology and terminology employed herein are for purposes of description and should not be regarded as limiting.

DETAILED DESCRIPTION OF THE DRAWINGS

Figure 1:
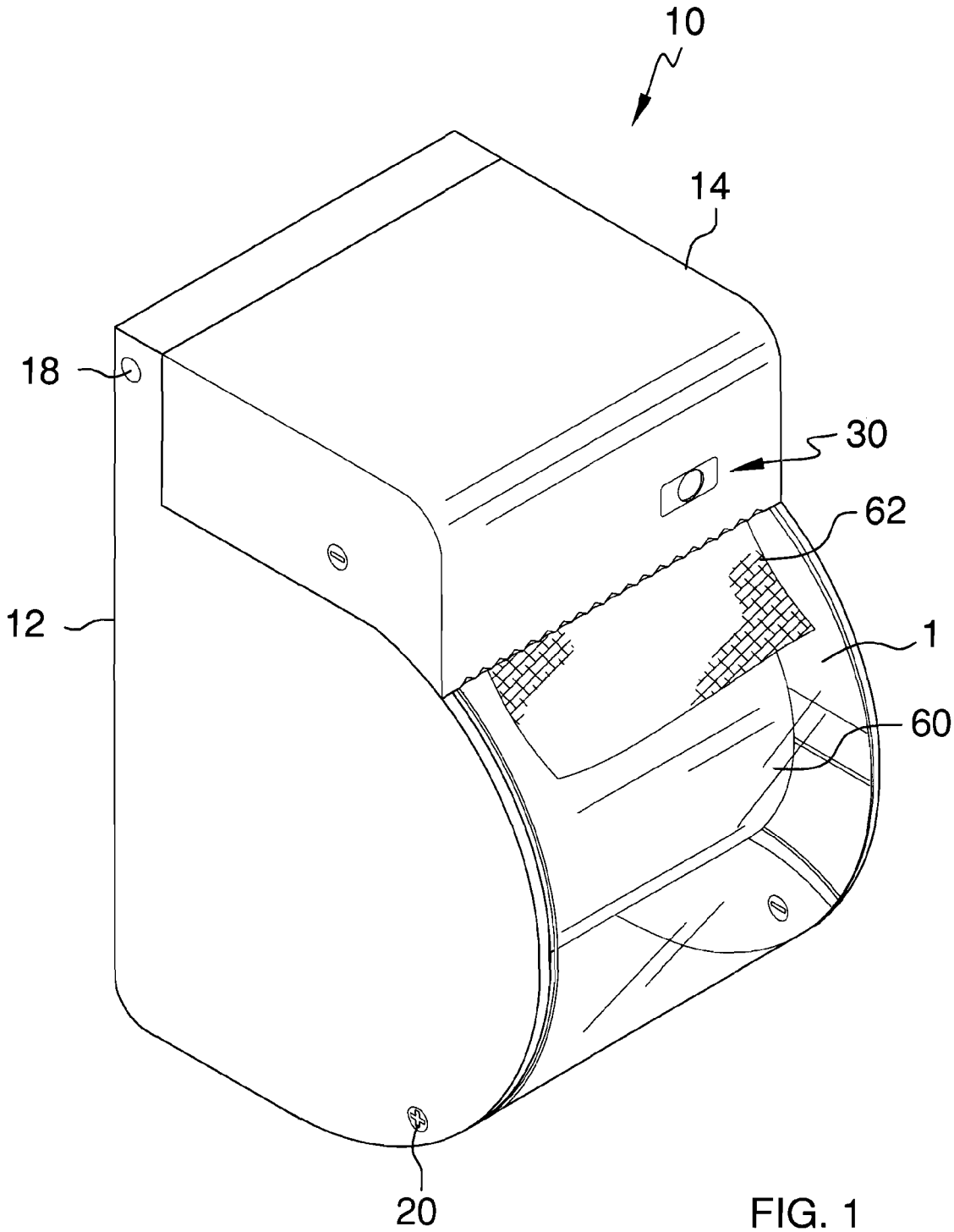
FIG. 1 is a perspective view.
Figure 2:
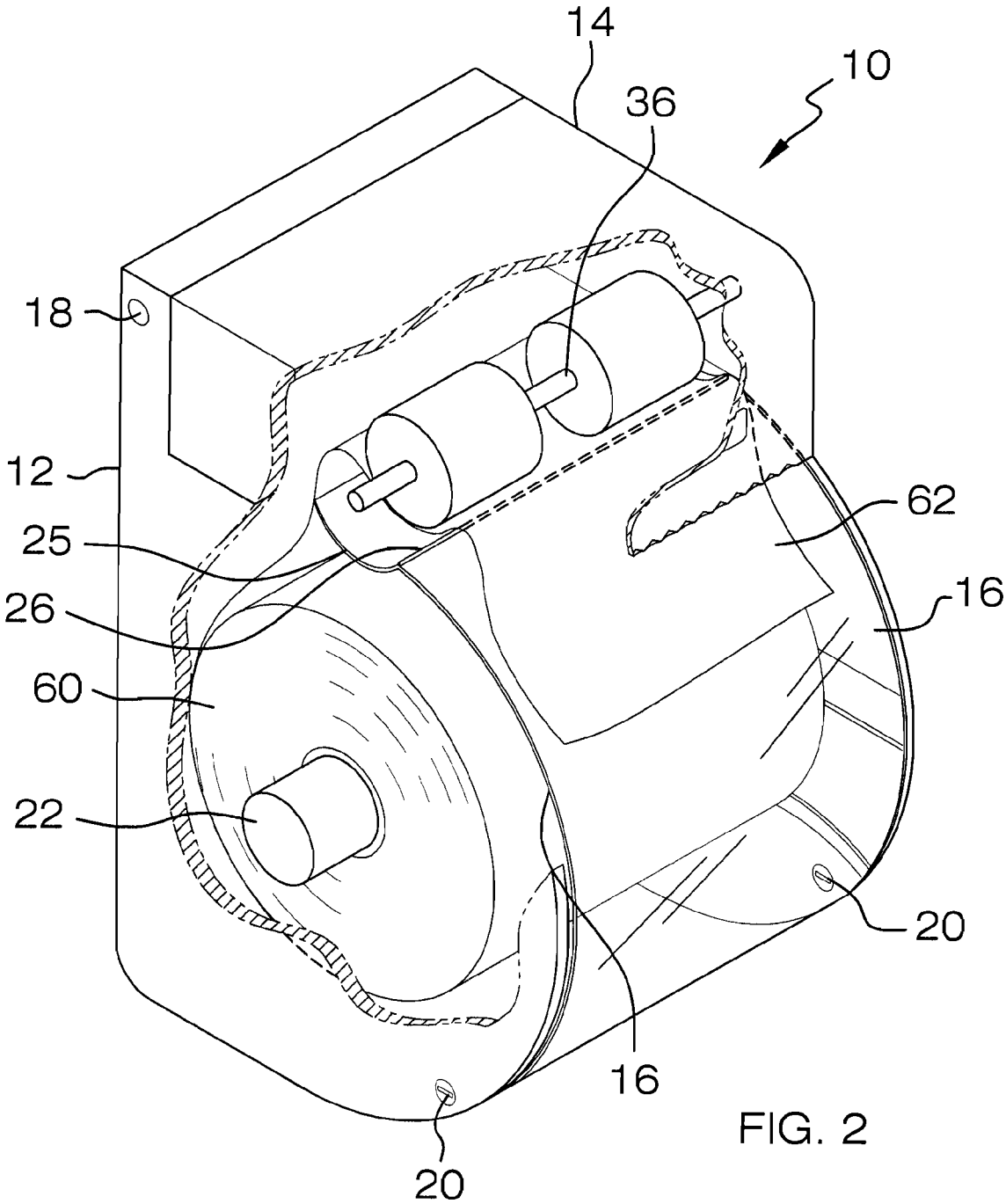
FIG. 2 is a partial cross sectional perspective view, illustrating tissue tray and rollers.
Figure 3:
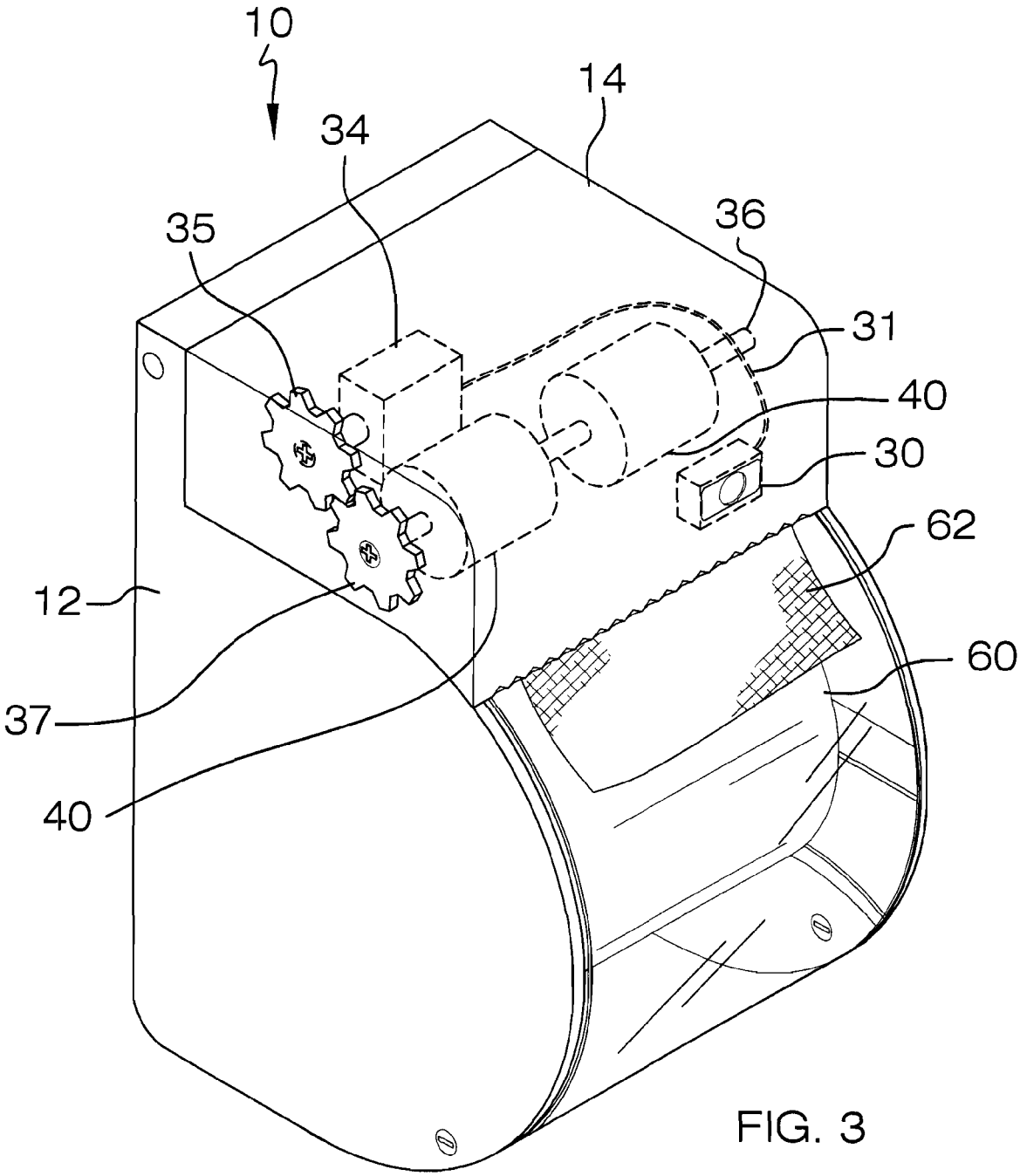
FIG. 3 is a partial cross sectional perspective view, illustrating gear drive of rollers.
Figure 4:
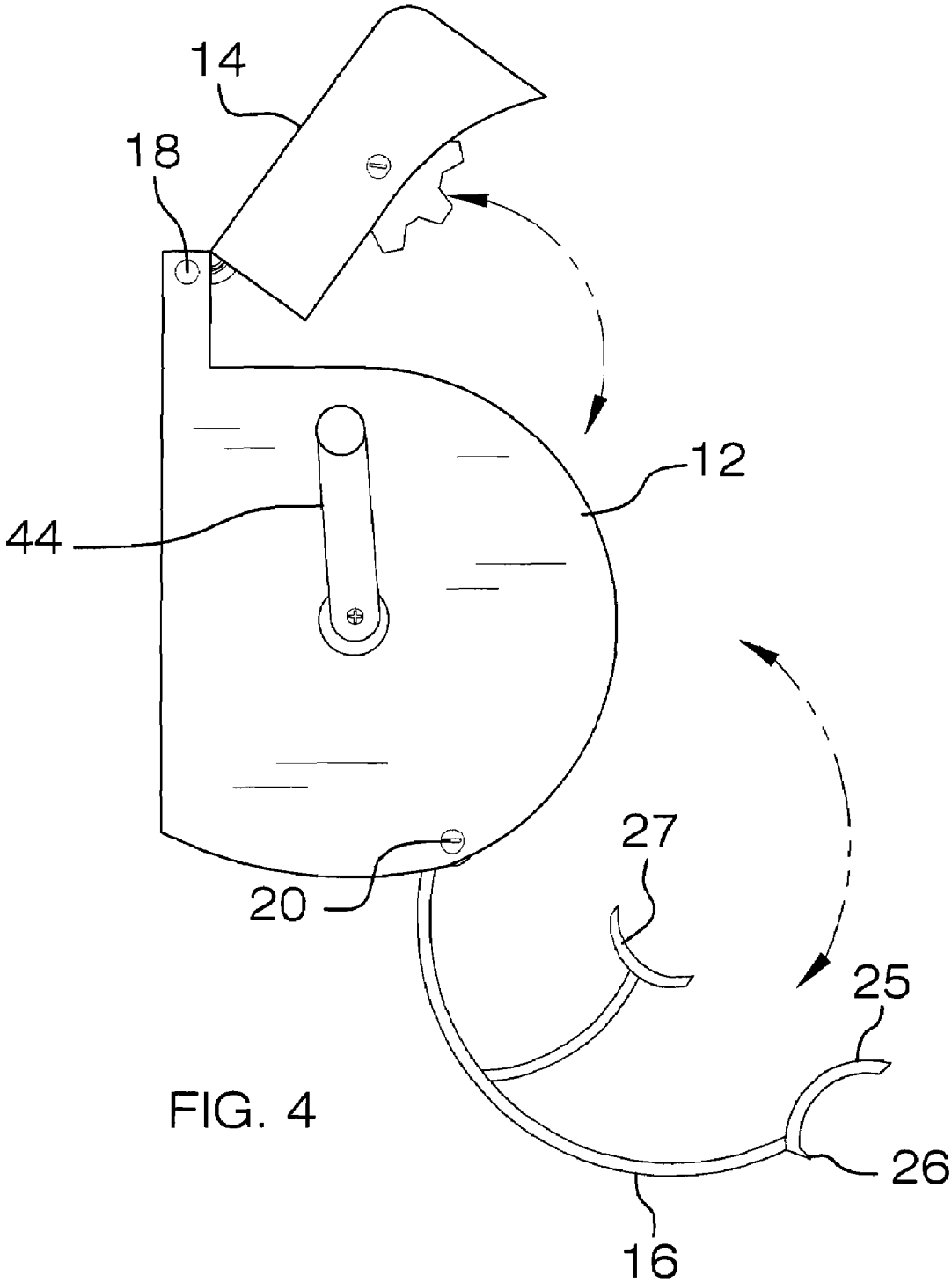
FIG. 4 is a side elevation view, with lid and cover opened.
Figure 5:
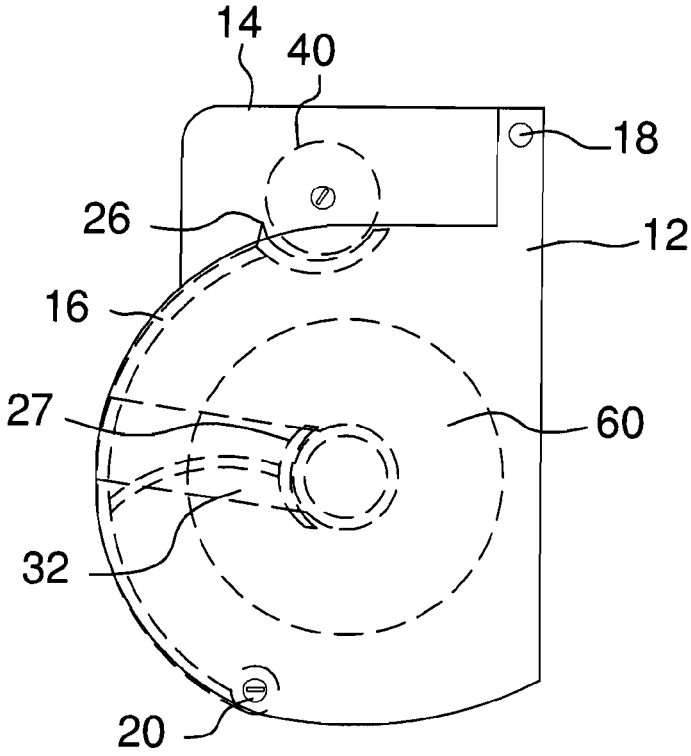
FIG. 5 is a lateral partial cross sectional view of the case and cover with tray and roll retainer.

With reference now to the drawings, and in particular FIGS. 1 through 7 thereof, the principles and concepts of the automatic tissue dispenser apparatus generally designated by the reference number 10 will be described.

Referring to FIGS. 1-5, the apparatus 10 comprises an automatic tissue dispenser apparatus 10 with user-determined output. The apparatus 10 is comprised of a case 12 having two spaced apart sides. The case 12 removably houses a roll of tissue 60. The bar 22 is removably held within the case 12. The bar channel 32 is disposed within one side of the case 12. The bar channel 32 provides for insertion and removal of the bar 22. The bar channel 32 in the case 12 side opposite the crank gear 46. The bar 22 removably fits through the tissue roll 60. The rounded transparent cover 16 is pivotally affixed to the front of the case 12, with the pivot disposed proximal to the bottom of the case 12. The lid 14 is pivotally attached to the top of the case 12 via lid pivot 18. The lid 14 has an inside and an outside. The semicircular tray 25 is disposed in the top of the cover 16. The tray 25 pivots outwardly as a part of the cover 16 when the lid 14 is lifted and pivoted about the cover pivot 20. The cutting edge 26 is disposed on the front side of the semicircular tray 25. The cutting edge 26 provides for cutting tissue 62 when the tissue 62 is selectively pulled downwardly. The c-cup 27 is connected to an approximate center of the cover 16. The c-cup 27 removably secures the roll of tissue 60 with cover 16 closure.

The motor 34 is affixed on the inside of the lid 14. The drive gear 35 is disposed on the motor 34. The roller axle 41 is rotatably affixed on the inside of the lid 14. The roller gear 37 is disposed on the roller axle 36. The roller gear 37 is in communication with the drive gear 35 of the motor 34. The pair of rollers 40 is disposed on the axle 36. The rollers 40 fit proximal to the upper surface of the tray 25 when the lid 14 is closed.

The rollers 40 are comprised of a soft rubberized material which gently drives the tissue 62 over the cutting edge 26 of the tray 25 and from there outwardly from the case 12. The motion sensor 30 is disposed within the lid 14. The motion sensor 30 communicates with the motor 34 via the electrical wire 31. The motion sensor 30 switches the motor 34 on and off, alternately, with each motion detected proximal to an exterior of the lid 14. A user can thereby select when to dispense tissue 62 and when to stop tissue 62 dispensing. The user tears tissue 62 via the cutting edge 26 as desired. The tissue 62 length is thereby user-determined.

Figure 6:
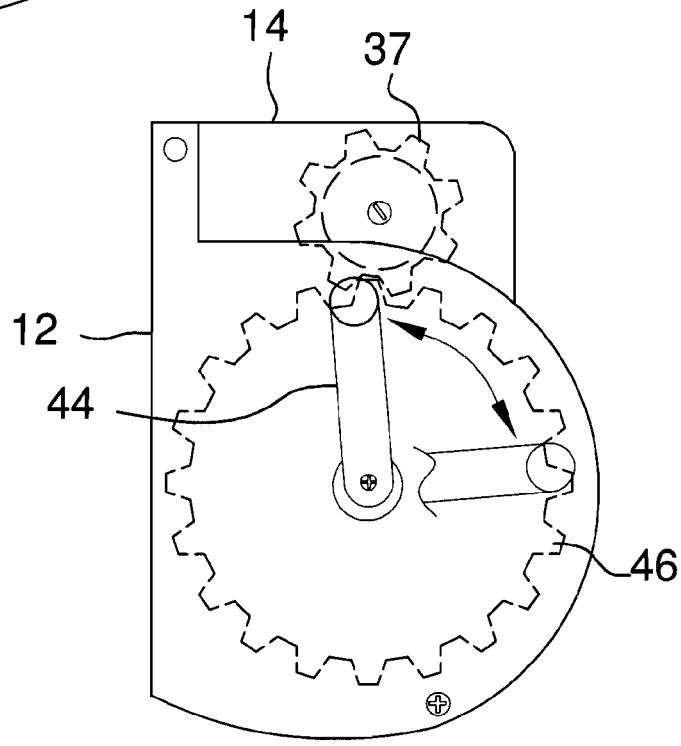
FIG. 6 is a lateral partial cross sectional view of the hand crank mechanism.

Referring to FIG. 6, the apparatus 10 is optionally provided with a crank gear 46 within one side of the case 12. The crank gear 46 is in communication with the roller gear 37. The crank gear is selectively driven by the externally disposed hand crank 44 in communication with the crank gear 46. In the event of user choice, motor 34 failure, power failure, or sensor 30 failure, the hand crank 44 provides for dispensing tissue 62. The apparatus 10 is conventionally powered by electrical outlet (not shown) or by battery (not shown).

Figure 7:
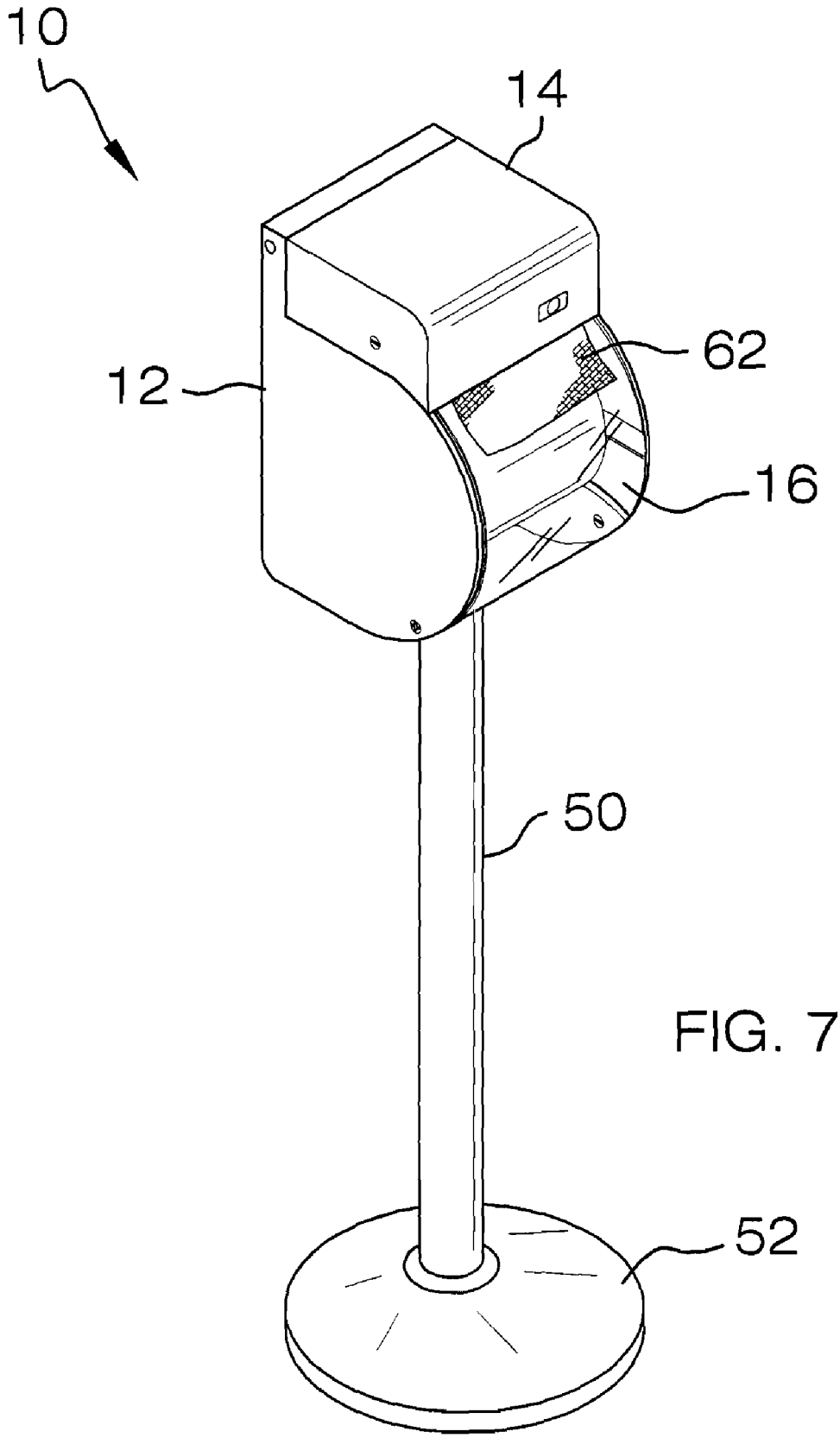
FIG. 7 is a perspective view of an embodiment equipped with the optional stanchion.

Referring to FIG. 7, the apparatus 10 is optionally provided with a stanchion 50. The round base 52 is disposed at the bottom of the stanchion 50. The apparatus 10 can thereby be self-supporting.

With respect to the above description then, it is to be realized that the optimum dimensional relationships for the parts of the automatic tissue dispenser apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the automatic tissue dispenser apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the automatic tissue dispenser apparatus may be used.

Therefore, the foregoing is considered as illustrative only of the principles of the automatic tissue dispenser apparatus. Further, since numerous modifications and changes will readily occur to those skilled in the art, it is not desired to limit the automatic tissue dispenser apparatus to the exact construction and operation shown and described, and accordingly, all suitable modifications and equivalents may be resorted to, falling within the scope of the automatic tissue dispenser apparatus.

What is claimed is:

1. An automatic tissue dispenser apparatus with user-determined output, the apparatus comprising:

a case having two spaced apart sides, the case for housing a roll of tissue;

a bar removably held within the case, the bar for removably fitting through the roll of tissue;

a lid pivotally attached to a top of the case, the lid having an inside and an outside;

a rounded transparent cover pivotally affixed to a front of the case;

a semicircular tray in a top of the cover;

a cutting edge on a front side of the semicircular tray;

a c-cup connected to an approximate center of the cover, the c-cup removably securing the roll of tissue;

a motor affixed on the inside of the lid;

a drive gear on the motor;

a roller axle rotatably affixed on the inside of the lid;

a roller gear on the roller axle, the roller gear in communication with the drive gear of the motor;

a pair of rollers on the axle, the rollers for fit proximal to a surface of the tray;

a motion sensor disposed within the lid, the motion sensor capable of switching the motor on and off, respectively, with each motion detected proximal to an exterior of the lid.

2. The apparatus in claim 1 further comprising a crank gear within one side of the case, the crank gear in communication with the roller gear;

an externally disposed hand crank in communication with the crank gear.

3. The apparatus in claim 2 further comprising a stanchion;

a round base for the stanchion.

4. The apparatus in claim 3 further comprising a bar channel within one side of the case, the channel in the case side opposite the crank gear.

5. The apparatus in claim 2 further comprising a bar channel within one side of the case, the channel in the case side opposite the crank gear.

6. The apparatus in claim 1 further comprising a stanchion;

a round base for the stanchion.

7. The apparatus in claim 6 further comprising a bar channel within one side of the case, the channel in the case side opposite the crank gear.

8. The apparatus in claim 1 further comprising a bar channel within one side of the case, the channel in the case side opposite the crank gear.

* * * * *